United States Patent [19]

Moore et al.

[11] 3,944,809

[45] Mar. 16, 1976

[54] LUMINAIRE WITH MOUNTING MEANS

[75] Inventors: William Cooper Moore; John David Kiss; John Richard Dean, all of Memphis, Tenn.

[73] Assignee: International Telephone & Telegraph Corporation, New York, N.Y.

[22] Filed: June 19, 1974

[21] Appl. No.: 480,617

[52] U.S. Cl. ..... 240/73 R; 240/84; 248/225; 248/300

[51] Int. Cl.[2] ..... F21V 17/00

[58] Field of Search ..... 240/41.5, 44.1, 41.6, 25, 240/84, 64, 72, 73 JC, 73 QD, 73 R; 248/73, 225, 223, 300

[56] References Cited

UNITED STATES PATENTS

| | | | |
|---|---|---|---|
| 1,074,712 | 10/1913 | Godley | 240/41.5 |
| 1,292,616 | 1/1919 | Kurz | 240/44.1 |
| 1,294,485 | 2/1919 | Huen | 240/41.5 |
| 2,707,748 | 3/1955 | Kocian | 240/41.6 X |
| 2,945,945 | 7/1960 | Rex | 240/41.5 X |
| 3,678,265 | 7/1072 | Porter et al. | 240/84 |
| 3,705,302 | 12/1972 | Judge et al. | 240/84 X |
| 3,755,665 | 8/1973 | Grindle | 240/41.55 |
| 3,814,928 | 6/1974 | Grosseau | 248/223 X |
| 3,836,763 | 9/1974 | Hoffman et al. | 240/41.6 |

*Primary Examiner*—L. T. Hix
*Assistant Examiner*—E. M. O'Connor
*Attorney, Agent, or Firm*—James B. Raden; Marvin M. Chaban

[57] ABSTRACT

A luminaire and mounting means are disclosed. Easy access into the luminaire for maintenance is provided by quick release trigger latches. Removal, replacement and alignment of a relfector and socket assembly are facilitated by slotted brackets on the reflector and within the housing.

5 Claims, 11 Drawing Figures

LUMINAIRE WITH MOUNTING MEANS

CROSS REFERENCE TO RELATED APPLICATION

A related application Ser. No. 480,951 filed June 19, 1974 in the names of W. C. Moore, J. D. Kiss and J. R. Dean has been assigned to the same assignee as the present application and is directed to a "Luminaire with Mounting and Adjustment Structure". This related application is hereby incorporated by reference.

BACKGROUND OF THE INVENTION

1. Field of the Invention

The present invention relates to luminaires for use in lighting extensive areas such as may be found along highways and which may be used for area lighting such as parking lots and the like. It relates more particularly to the servicing of such luminaires and especially to efficient arrangements permitting rapid removal and installation of critical components of such luminaires.

2. Description of the Prior Art

Luminaires used for outdoor lighting frequently employ mercury vapor and sodium vapor lamps which provide high-intensity light. Typical installations, in the past, have involved the placement of the luminaires on long arms extending from the tops of high poles near the areas to be illuminated. Along highway rights-of-way, for example, long lines of posts close to the roadway have been necessary with mast arms extending over the roadway. Such lines of posts with long mast arms located close to, or extending over, the edges of the road are not generally considered to be esthetically attractive and are recognized to present a definite hazard of collision for any vehicles which go out of control and off the road. Damage to posts and luminaires located close to highways is a cause of serious losses every day.

To overcome the disadvantages of long mast arms and closely spaced poles, a new reflector and a new refractor have been provided which, when mounted together with a lamp in a suitable housing, produce intense twin beams of light providing a rectangular area of illumination more uniform than has heretofore been commercially feasible with such lamps. This development enables superior illumination over a long and substantially rectangular area of increased size from lamps of a given size which are located farther from the area than hitherto. However, this capability to illuminate a larger and rectangular area from a greater distance carries with it requirements relating to arrangements of reflectors and refractors and particularly to their manner of assembly on the upper ends of straight posts which make it difficult to service the luminaires.

SUMMARY OF THE INVENTION

An object of this invention is to provide improved illumination for larger areas without increasing lamp size and power requirements and to direct the illumination onto substantially rectangular areas. It is intended, along with improved illumination, to enable increases in spacing between luminaires and between a roadway or other area to be illuminated and the luminaires. It is an object, by enabling a reduction in the number of poles and increases in their spacing from a roadway, to reduce the hazards of vehicles striking them.

It is a further object of the invention to simplify the installation of luminaires on support posts while making it possible to readily position the luminaires and to aim them so that illumination is provided over specified areas.

An additional object of our invention is to provide luminaires constructed in accordance with the invention in a manner enabling them to be more readily serviced.

The foregoing objects are realized in the present invention through use of improved reflector and refractor elements in a luminaire together with improved means for mounting, aiming and servicing luminaires. Improvements in servicing relate to the provision of fastener means enabling the reflector and lamp socket assembly to be removed from behind the lens and replaced easily and efficiently. In addition to enabling ready removal and replacement of the reflector, the fastener means enables proper alignment of the reflector even though the position of the refractor when the housing is open prevents the workman from actually seeing the fastener means.

BRIEF DESCRIPTION OF THE DRAWINGS

The above mentioned and other features and objects of this invention and the manner of obtaining them will become more apparent, and the invention itself will be best understood by reference to the following description of an embodiment of the invention taken in conjunction with the accompanying drawings, in which.

Figure 1:
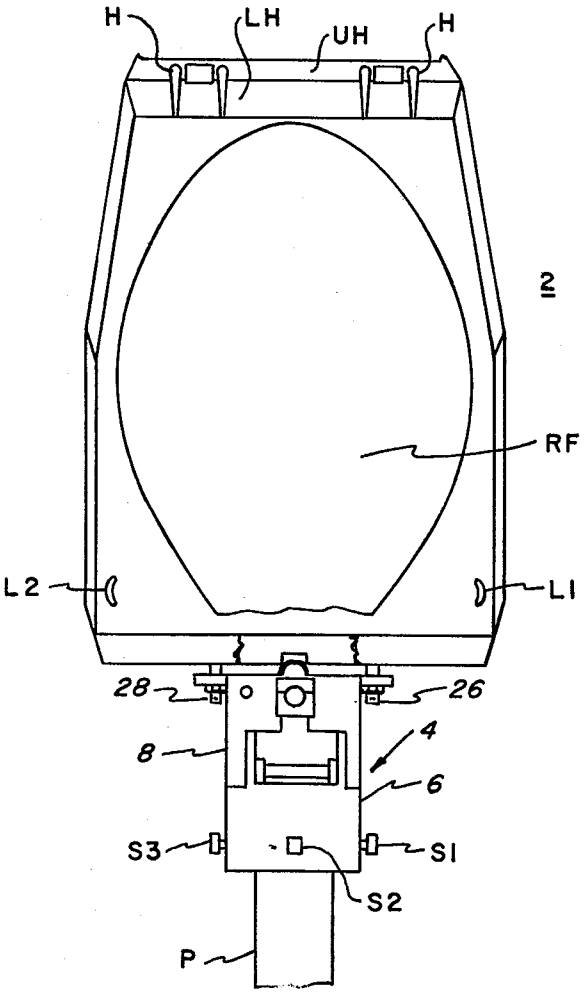
FIG. 1 is a view in perspective of a luminaire and mounting means positioned on a post in accordance with the invention.

DESCRIPTION OF PREFERRED EMBODIMENTS:

Turning first to FIG. 1, there is shown a view of a luminaire 2 according to the invention as it would appear when mounted for usage on a post P. By tightening set screws in the base plate 6 at S1, S2, S3 and S4 in a selective manner, the base assembly 4 and the luminaire 2 may be fastened to the post P and may be accurately positioned about an axis normal to the center of the post so that illumination from the luminaire will be directed onto a plane parallel to and coincident with at least a major portion of the area to be illuminated. In the event the post is not vertical or the area to be illuminated is not horizontal, a first and a second setting are provided. As a first of these, the screws S1–S4 are tightened. Secondly, the selective tightening of nuts on bolts 26 and 28 may be used to set the luminaire relative to the plane of the top surface of the base assembly.

In the view shown in FIG. 1, the luminaire includes an upper housing UH to which a lower housing LH is attached by hinges at H. This construction makes it possible to open the lower housing by release of clips, or latches, at L1 and L2, permitting the lower housing LH to swing out and provide access to parts within the upper housing. This construction is advantageous when the luminaire is in use and particularly when elevated on a post, since it permits opening the housing and closing it without removing and handling heavy housing elements. Hinging the lower housing LH to the upper housing UH permits the refractor lens RF to swing out from the upper housing when the luminaire is opened and minimizes the risk the refractor will hit personnel or be smashed against the housing or the post.

Figure 2:
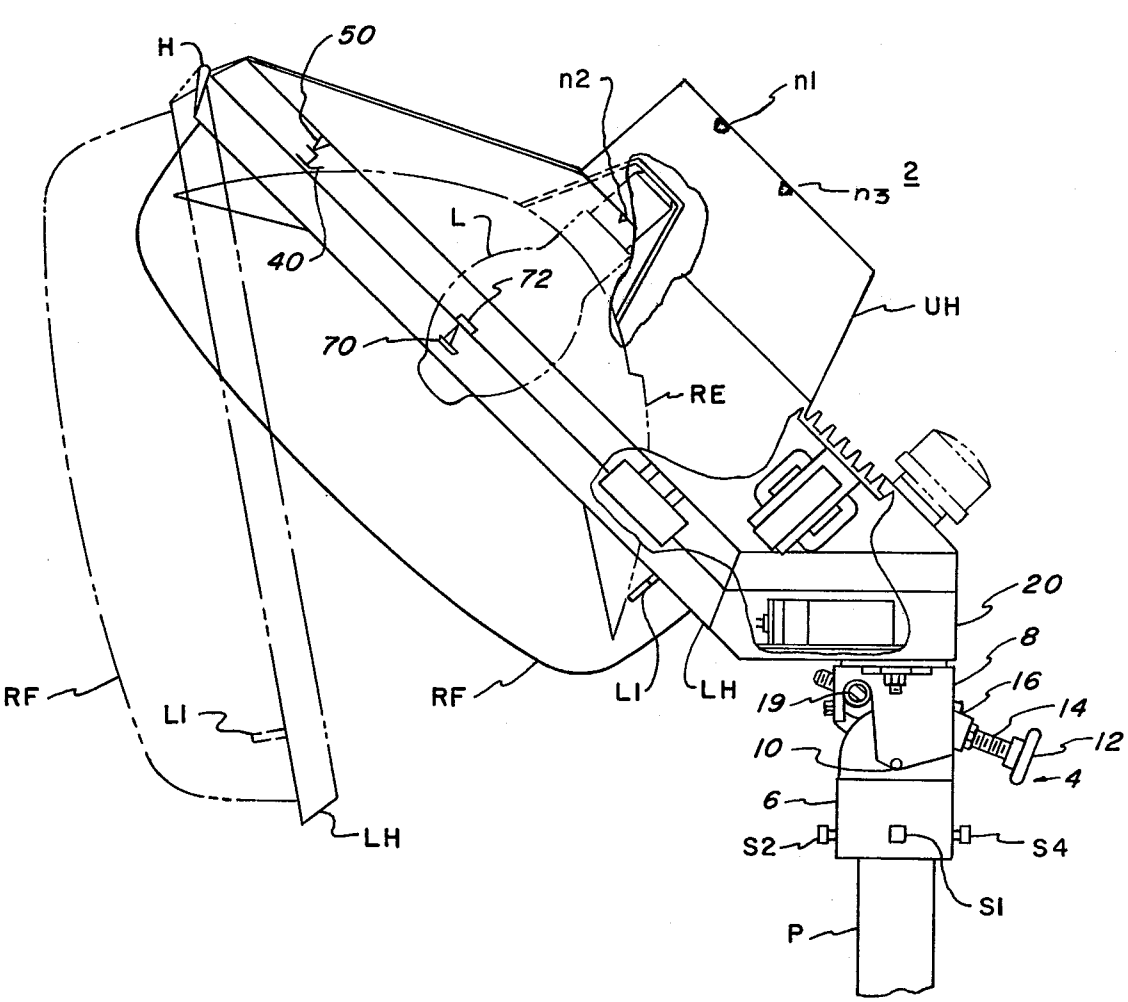
FIG. 2 is a side view in partial section of a luminaire and mounting in accordance with the invention and showing the luminaire in both open and closed positions.

A general view of a luminaire 2 and base assembly 4 is shown in FIG. 2 in position on a post P in accordance with the invention. The base assembly 4 is mounted by means of screws S1, S2, S3 and S4 on the pipe P to provide a support for the base of the housing 20 and for the luminaire 2. The knob 12 can be used to turn the screw 14 in a spacer 16 and in cooperation with the pivot rod 19 to adjust the angle of inclination of the luminaire relative to its mounting. The luminaire base 20 is secured to base casting 8 in a mounting allowing side-to-side adjustment of the luminaire relative to the base casting 8. The luminaire may be aimed, by turning knob 12, to position the beam of illumination relative to the area it is desired to illuminate. The details of construction allowing this aiming are shown in our co-pending application as previously cited.

The upper housing UH is fastened to the base of the housing 20 by conventional bolts or other means. The upper housing supports the lamp L in a manner chosen to optimize illumination from the luminaire via the reflector RE and the refractor RF. The upper housing supports the reflector RE in a manner permitting its ready removal from the housing as is explained subsequently. The lower housing is supported by a hinge at H which is secured to the upper housing UH. The refractor RF is supported by the lower housing LH.

In FIG. 2, the lower housing and the refractor are illustrated in solid lines as they appear when the luminaire is closed for use. They are shown also in dashed lines as they would appear when the luminaire is opened for servicing. This figure, in conjunction with more detailed showings in other figures, is believed to be useful to a discussion of certain problems and how they have been overcome by the invention.

The lower housing LH may be rotated from its open position (dashed lines) about its hinge at H against the upper housing UH and then be fastened by latches at L1 and L2 to the upper housing and held in its closed (solid lines) position. Release of the latches L1, L2 will permit the lower housing to swing open about the hinge H, carrying the refractor along to the open position of FIG. 2 (dashed lines). A workman charged with maintenance of the assembly, will stand to one side to release the latches and permit the refractor, which may weigh as much as 23 pounds in a preferred embodiment, to fall into the open position. Suitable upper and lower seals are provided, one between the refractor and the lower housing and the other between the lower housing and the upper housing. Suitable seals are indicated at G1 and G2 in FIG. 3.

The open position of the lower housing and refractor, as shown in FIG. 2, presents a problem to a repairman. In a preferred embodiment, the lower housing has dimensions of about 2¼ feet by 1¼ feet and supports a 23-pound refractor. These dimensions, the position of the refractor when the housing is opened and the height above ground preclude direct access to the reflector. For a workman to remove and replace the reflector, he must stand to the left of the open housing, in the view shown in FIG. 2, facing the outside of the refractor and he will be unable to see the reflector and the means holding it in place. To overcome this problem, fastening means (FIG. 3) is provided on the reflector at 40, 70 and 80 (not shown) and on the upper housing at 50, 72 and 82 (not shown) to enable a workman to remove and replace the reflector in accordance with the invention using both hands in the process without actually being able to see the latches 40 and 50.

Various elements of the luminaire, including lamps, housings, capacitors, ballast, cooling vanes and the like are shown in FIG. 2. The power elements shown are conventional and may be replaced with a "power pad" in accordance with the disclosure in U.S. Pat. No. 3,761,781. The housing base 20 and the elements it supports are placed immediately above the base assembly 4 to put as much weight as possible immediately over the pipe and thus to reduce the forces which would tend to twist or bend the pole out of the vertical.

Notches are indicated at *n*1, *n*2 and *n*3 on the upper housing 22. Three similar notches, not shown, are located on the opposite side of the upper housing. These notches are precisely located on the housing so that they may be used in aligning the luminaire. A line of sight observation from the back of the upper housing along *n*1 and *n*2, or *n*2 and *n*3 will establish a point of reference on the surface to be illuminated. This aiming is directed at the remote curb of a roadway to properly orient the luminaire relative to the roadway. This point may be used to establish the best position of the light pattern with relation to the roadway. This will enable the installer to determine whether the luminaire is installed correctly or not and give a basis against which correction of any errors may be made. It will be recognized that a similar check and adjustment will be possible using the two notches on the other side of the housing. In this connection, it should be noted that the lamp-reflector-refractor combination produces twin beams, one on either side of a central plane through the axis of the lamp where the central plane would be substantially coplanar with the surface of the paper in the view of FIG. 2, with the area between the beams illuminated to a slightly lesser degree. Other alternative aiming means may also be used.

The base assembly 4 includes a base plate 6, or tenon fitter which can be fastened to the pole P by tightening the screws S1, S2, S3 and S4.

Having adjusted the luminaire to throw light onto a selected plane, which in the usual situation will be along a roadway or area to be illuminated and will usually be horizontal or nearly so, there remains the problem of aiming the luminaire so that the light will be spread over an area congruent with the area of the roadway to be illuminated. This problem is solved by changing the angle of the luminaire relative to the horizontal.

The angle or attitude of the luminaire may be adjusted about a pivot at 10 in the base plate, or tenon fitter, 6. This is accomplished by turning the knob 12 which is coupled to the bolt 14 which in turn is threaded to pass through the clearance diameter of spacer 7 to pull against a pivot rod at 19 which is held in a hole in the adjustment casting 8. The pivot rod 19 translates the motion of the screw to the adjustment casting 8, causing it to move about the pivot point 10. The casting 8 is connected to the base of the housing 20 of the luminaire and carries the luminaire along as it pivots about pivot point 10. Adjustment of the angle by which the luminaire projects light is made in this way by turning the knob 12. Precise sighting of the area to be illuminated is possible using the notches *n*1 and *n*2 or *n*2 and *n*3 previously referred to.

Figure 3:
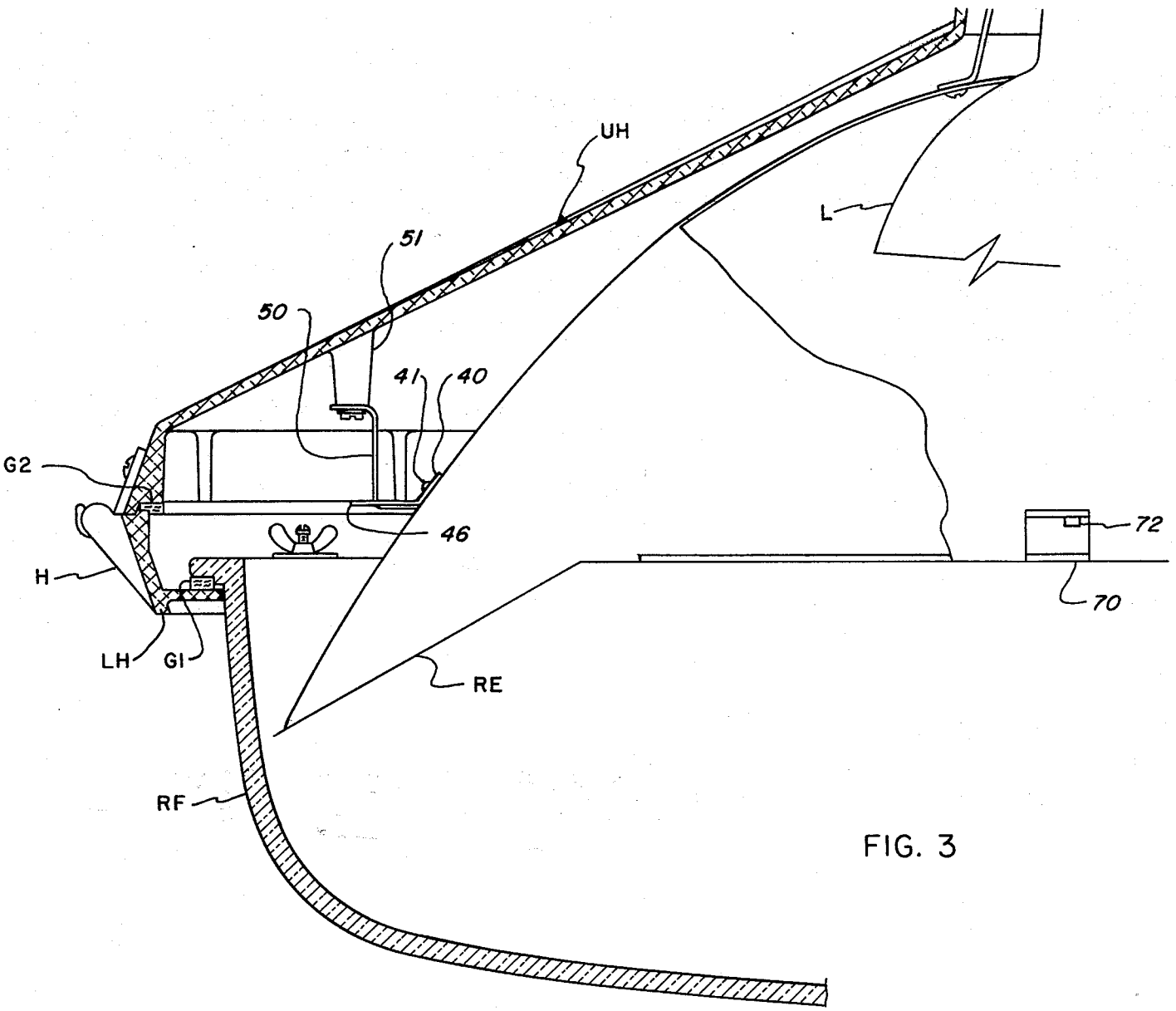
FIG. 3 is a view in partial section of a portion of a luminaire depicting the front of the reflector and the means by which the reflector is fastened to the upper housing of the luminaire.
Figure 4A:
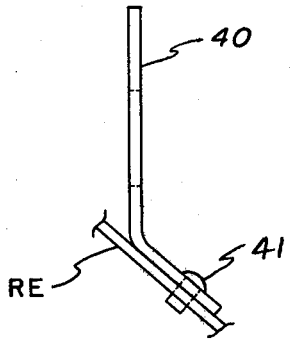
FIGS. 4A and 4B show details of the front reflector clip, which is attached to the reflector.
Figure 4B:
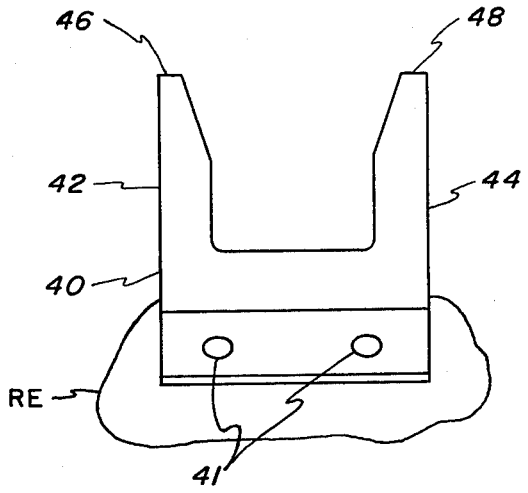

FIG. 3 includes a view of a fastener, or front reflector clip, 40 secured by suitable, spaced screws or rivets 41, on the end of the reflector called the front of the reflector. The front of the reflector is at the top of the reflector in the view shown in FIG. 2 and to the left in the view shown in FIG. 3. FIG. 4A is a side view of the reflector clip 40. FIG. 4B is a view from the right side of FIG. 4A showing arms at 42 and 44 terminating in tips 46, 48. The tapers towards the ends of the arms may be used in positioning and securing the reflector in the upper housing.

Figure 5A:
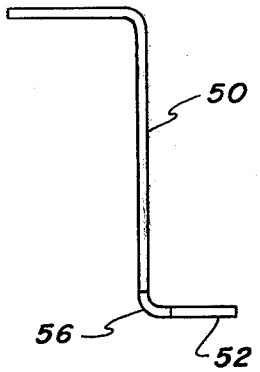
FIGS. 5A and 5B show details of construction of the reflector register which is attached to the upper housing for mating with the front reflector clip and thus aligning the reflector and securing it to the upper housing.
Figure 5B:
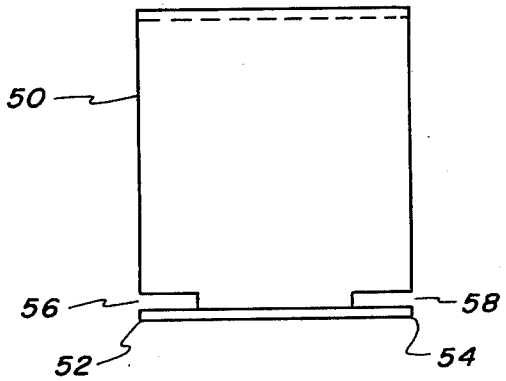

FIG. 3 includes a view of a sheet metal bracket fastener 50 which is secured by suitable screws S1 extending through opening 53 in the fastener for securement to spaced bosses 55 in the upper housing UH. FIG. 5A is a side view of the reflector fastener 50 corresponding to the view of FIG. 3. FIG. 5B is a side view of FIG. 5A showing wings 52 and 54 which establish openings 56 and 58 which can be employed to engage the arms 42 and 44 of the front reflector clip and secure the reflector in the upper housing.

Figure 6:
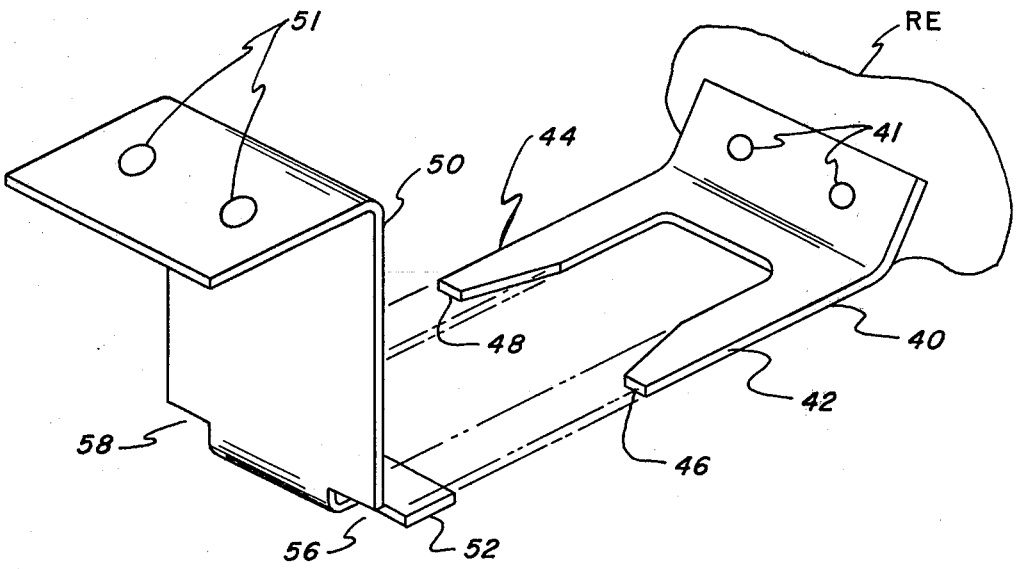
FIG. 6 is a perspective view of the reflector register and of the reflector clip showing how they may be aligned to fit together.

FIG. 6 is an enlarged view in perspective of the reflector register 50 and the reflector clip 40. In this view they are shown as they would appear when lined up prior to engagement of the openings 56, 58 with the tips 46, 48 of the arms 42, 44.

Figure 7A:
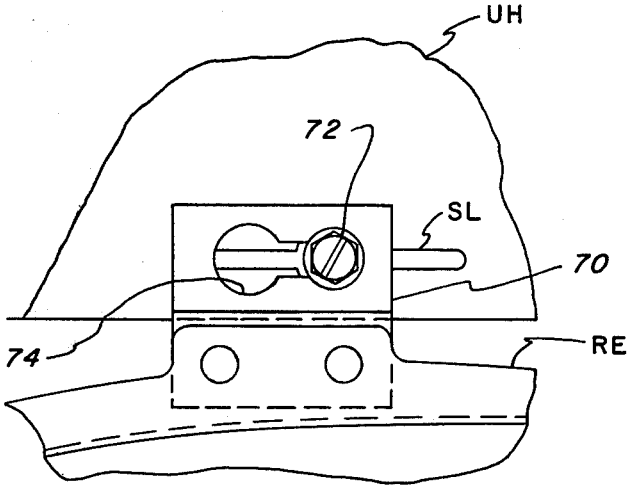
FIGS. 7A, 7B and 7C show details of the construction and placement of one of the reflector mounting brackets.
Figure 7B:
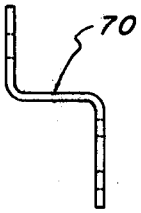
Figure 7C:
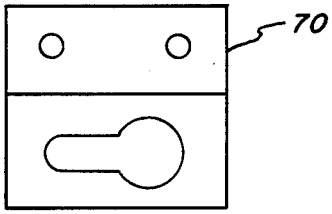

FIG. 7A is a view of a fastener combination 70, 72 to enable the reflector RF to be fastened more securely to the upper housing than is possible with only the reflector register 50 and the front reflector clip 40. The reflector mounting bracket 70 may be fastened to the reflector RE by rivets as shown in FIG. 7A; however, any suitable fastener devices may be used. The reflector mounting bracket may be connected to the upper housing through use of a screw 72. This screw may be loosened, allowing the bracket 70 and reflector RE to slide back along boss SL on the casting to permit the head to pass through the enlarged slot opening at 74 and release the reflector from the upper housing. Views of the reflector mounting bracket 70 are shown in FIGS. 7B and 7C. Fasteners for use on the other side of the luminaire will be the mirror images of the fasteners in FIGS. 7A, 7B and 7C.

The reflector may be removed from the upper housing as follows. The workman first loosens the two fasteners L1 and L2 releasing the lower housing and allowing it to swing open about the hinge H, as indicated by dashed lines in FIG. 2. He then loosens the two fasteners at 72, 82 (hidden from view in FIG. 2) and stands to the left or right of the open lower housing. This places him to the left or right of the refractor and facing the refractor as it appears in dashed lines in FIG. 2. From this position he cannot see the fasteners when he reaches around the refractor from both sides and pulls the reflector down over the fasteners 72, 82 pulling the arms 42 and 44 of front reflector clip 40 free from the openings 56 and 58 formed by the wings 52 and 54 on the reflector register 50.

The reflector is replaced in the upper housing by grasping the reflector on each side and placing the front end into the upper housing. The shape of the arms 42, 44, their ends 46, 48 and of the openings 56, 58, as best shown in FIG. 6, are such that they enable a workman whose view is obscured by the reflector (so that he cannot see the reflector clip 40 nor the reflector register 50) to place the arms 42 and 44 into the openings 56, 58. In the process, the arms 42 and 44 and openings 56 and 58 enable the placement of the reflector in the exact position it should occupy in the upper housing to insure efficient operation of the luminaire. After the reflector has been pushed into the correct position relative to the reflector clip 40 and the reflector register 50, it may be secured further by tightening the fasteners at 70, 72 and 80, 82.

While the principles of the invention have been described above in connection with specific apparatus and applications, it is to be understood that this description is made only by way of example and not as a limitation on the scope of the invention.

We claim:

1. A luminaire having one end adapted to mount on a vertical mast spaced from an area to be illuminated, said luminaire comprising an enlarged main housing having a surround wall generally downwardly-facing to form an open mouth defining the rim of said main housing, an inverted bowl-shaped reflector having a rim portion extending out of said mouth at an end remote from said one end, a bowl-shaped refractor housing hinged to said housing at said end remote from said one end, said refractor housing including a refractor affixed to said refractor housing configured to close the open mouth of said housing, means for releasing said refractor housing to cause said refractor housing to depend from said remote end to partially uncover said mouth for access to the interior of said main housing, a reflector mounting bracket recessed in said main housing adjacent the remote end thereof, said bracket comprising a depending wall and an end wall stepped from said depending wall with said walls inset in said main housing, a forked member affixed to said reflector intermediately along the bowl shape thereof for mating with said bracket to position said reflector in said main housing, said bracket end wall defining a landing surface for retaining thereon said forked member as the reflector is advanced into said main housing, and notches in said depending wall for receiving said forked member in a tight-fitting relationship to locate and to hold said reflector relative to the remote end of said main housing and relative to sides of the wall thereof.

2. A luminaire as claimed in claim 1, wherein there are stepped bayonet fastening members on said reflector at the sides thereof and means mounted on said main housing wall for slidably engaging said fastening members as the forked member is advanced on said bracket landing.

3. A luminaire as claimed in claim 1, wherein said forked member includes a pair of flat tines with an entrance portion of each of said tines tapered along the inside thereof to facilitate mating entry onto said bracket.

4. A luminaire as claimed in claim 1, wherein said main housing includes an external cap of generally rectangular cross section at the side of said main housing opposite said open mouth, and including parallel sides, and a plurality of rear sighting members in the parallel sides of said cap, and front sighting members on the sides of said main housing for visual line of sight aiming in conjunction with one of the rear sighting members along the same side of the luminaire toward an area to be illuminated by said luminaire.

5. A method for inserting a reflector into the upper housing of a luminaire to which a lower housing supporting a refractor is attached by hinges, comprising the steps of opening the luminaire while standing to one side by releasing fasteners on each side of the lower housing permitting it to depend from the upper housing, sliding a fork mounted on the front of the reflector onto a stationary bracket internally in the housing, partially advancing the fork onto the bracket, setting the opposite sides of the reflector within bayonet fasteners on opposite sides of the housing, advancing the fork fully onto the bracket to position the front of the reflector within the upper housing, and tightening the bayonet fasteners to properly position the sides of the reflector.

* * * * *